US008393401B2

(12) United States Patent
Yokley et al.

(10) Patent No.: US 8,393,401 B2
(45) Date of Patent: Mar. 12, 2013

(54) LINER HANGER RUNNING TOOL AND METHOD

(75) Inventors: John M. Yokley, Kingwood, TX (US); Pat M. White, Missouri City, TX (US); Tommie J. Graham, Jr., Houston, TX (US)

(73) Assignee: Dril-Quip Inc., Houston, TX (US)

( * ) Notice: Subject to any disclaimer, the term of this patent is extended or adjusted under 35 U.S.C. 154(b) by 277 days.

(21) Appl. No.: 12/542,037

(22) Filed: Aug. 17, 2009

(65) Prior Publication Data

US 2011/0036594 A1 Feb. 17, 2011

(51) Int. Cl.
*E21B 23/04* (2006.01)

(52) U.S. Cl. ..... 166/382; 166/208

(58) Field of Classification Search ..... 166/208, 166/212, 377, 382, 383
See application file for complete search history.

(56) References Cited

U.S. PATENT DOCUMENTS

| | | | | | |
|---|---|---|---|---|---|
| 3,897,823 | A | * | 8/1975 | Ahlstone | 166/120 |
| 3,924,678 | A | * | 12/1975 | Ahlstone | 166/120 |
| 4,051,896 | A | * | 10/1977 | Amancharla et al. | 166/123 |
| 4,067,388 | A | * | 1/1978 | Mouret et al. | 166/208 |
| 4,583,593 | A | | 4/1986 | Zunkel et al. | |
| 4,603,743 | A | | 8/1986 | Lindsey, Jr. | |
| 5,018,582 | A | * | 5/1991 | Baker | 166/382 |
| 5,404,955 | A | * | 4/1995 | Echols et al. | 166/382 |
| 6,739,398 | B1 | | 5/2004 | Yokley et al. | |
| 2004/0194954 | A1 | | 10/2004 | Cram et al. | |
| 2007/0272420 | A1 | | 11/2007 | Reimert et al. | |

* cited by examiner

*Primary Examiner* — Nicole Coy
*Assistant Examiner* — Robert E Fuller
(74) *Attorney, Agent, or Firm* — Baker Botts L.L.P.

(57) ABSTRACT

A liner hanger running tool (10) and method are provided for positioning a liner in a well bore. A tool mandrel (24) is supported from a running string, and a housing (44) surrounds the tool mandrel. A flow annulus between the mandrel and the housing allows fluid to pass upward through the running tool to a position above the liner. A hydraulic release mechanism (78, 79) is activated by fluid pressure within the mandrel to axially move a piston (50) positioned radially outward of the mandrel to release the running tool from the liner.

20 Claims, 10 Drawing Sheets

LINER HANGER RUNNING TOOL AND METHOD

FIELD OF THE INVENTION

The present invention relates to running tools of the type commonly used in the hydrocarbon recovery industry to run tools to a desired depth in a well, and to frequently perform one or more operations on such downhole tools. More particularly, the present invention relates to an improved liner hanger running tool and method.

BACKGROUND OF THE INVENTION

Liner hanger running tools have been used for decades to run liner hangers into a well. The prior art liner hanger running tools are disclosed in U.S. Pat. Nos. 4,583,593 and 4,603,543, and Publication 2004/0194954A1.

One of the significant problems with running a liner hanger in a well concerns the high loads conventionally applied at the surface to push, pull, rotate and/or drill the liner in place. These high loads are in part due to the liner compressing fluids in the well during a liner run-in operation. Fluid bypass between the liner and the casing is typically quite limited.

A tool was manufactured and sold for use in a tar application, wherein the tool had an internal fluid bypass to aid in getting the liner to the desired depth in the wellbore. The internal bypass in the running tool allowed the fluid to flow upward through the inside of the liner and through the bypass in the running tool, and then exit above the liner. The liner running tool was attached to a liner running adapter by a c-ring. When the liner was run to the releasing depth, the mechanical running tool was rotated to the right to shear a set of pins, so that continued right hand rotation would move a releasing sleeve up to release a c-ring from the running adapter. Both right hand rotation and torque to the liner are limited in this tool by the shear pin releasing concept.

The disadvantages of the prior art are overcome by the present invention, and an improved liner hanger running tool and method of operating such a tool are hereinafter disclosed.

SUMMARY OF THE INVENTION

In one embodiment, a liner hanger running tool is provided for positioning a liner hanger within a casing in a wellbore. The tool includes a tool mandrel supported on a running string, and a housing surrounding the tool mandrel. When run in a well, the upper end of the liner circumferentially surrounds at least a portion of the running tool. The tool internal bypass extends between an outer surface of the mandrel and an inner surface of the housing. A sealed flow line is provided between a through hole in the mandrel and a through hole in the housing to provide a radial fluid flow path through the tool. A hydraulic release mechanism is activated by fluid pressure within the mandrel to axially move a piston radially outward of the housing and thereby to release the running tool from the liner.

These and further features and advantages of the present invention will become apparent from the following detailed description, wherein reference is made to the figures in the accompanying drawings.

DETAILED DESCRIPTION OF PREFERRED EMBODIMENTS

Figure 1A:
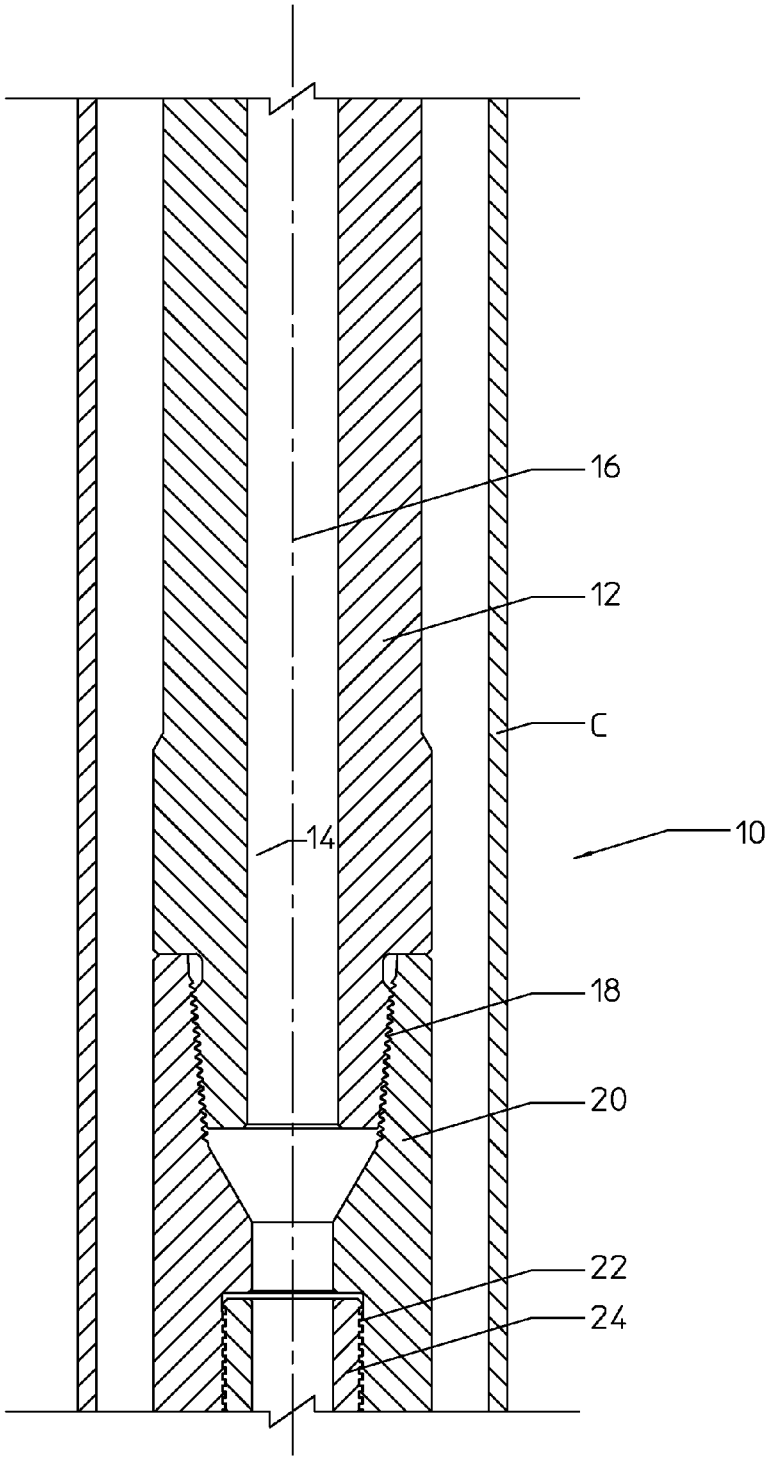
FIG. 1A is a cross-sectional view illustrating an upper portion of the tool interconnected to a work string.
Figure 1B:
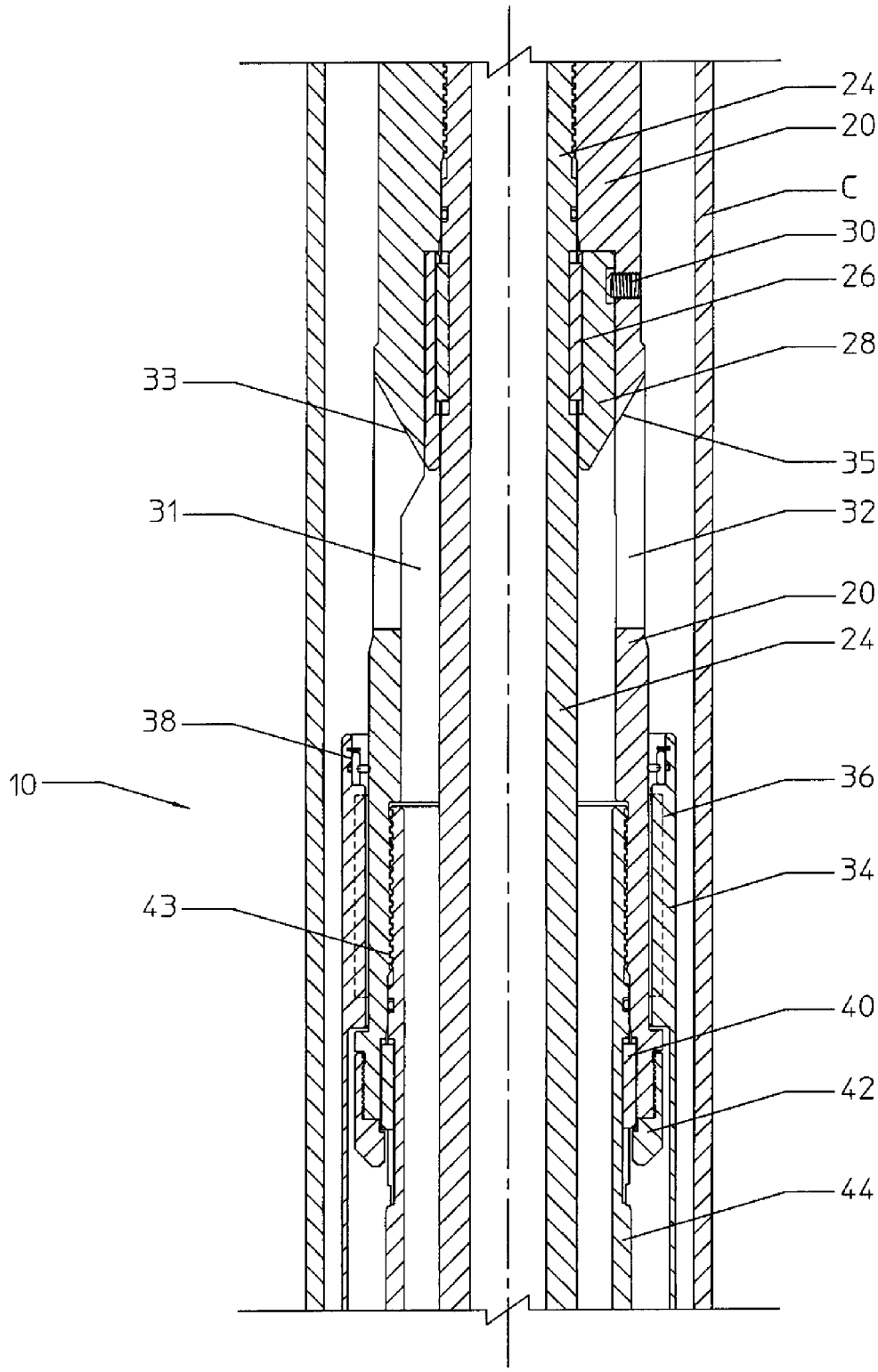
FIG. 1B illustrates a mid portion of the tool, illustrating an annulus between the tool mandrel and the tool housing.

FIGS. 1A-1E depict a suitable liner hanger running tool 10 positioned within a casing C. Tool 10 may be supported in a well on drill pipe 12 having a bore 14 and a central axis 16. Threads 18 interconnect the drill pipe 12 to top sub 20, which is threaded at 22 to inner mandrel 24. As shown in FIG. 1B, keys 26 rotatably interconnect the inner mandrel 24 and offset bushing 28, which is pinned at 30 to a lower end of the top sub 20. Slot 32 allows fluid to exit the annulus 31 radially outward of mandrel 24, as explained subsequently. Conical surface 33 on the offset bushing 28 and mating surface 35 at the lower end of top sub 20 provide a guiding surface for discharging fluid moving upward in the annulus 31 and out the slot 32, so that fluid may pass upward between the tool 10 and the casing C and thereby allow the tool and liner to be more easily run in the well. The offset bushing 28 allows torque to be transmitted from the top sub 20 to the inner mandrel 24 through the keys 26, thereby allowing torque to be transmitted through the tool to a bottomhole assembly at the lower end of the liner.

Top sub 20 is threaded at 43 to outer piston mandrel 44. Clutch 34 is positioned circumferentially about a lower end of the top sub 20, and a splined connection 36 rotationally interconnects the top sub 20 and the clutch 34. Keeper 40 locks the top sub 20 to the outer piston mandrel 44, and is retained by cap 42. The piston mandrel 44 is structurally an extension of the top sub 20. T-seal assembly 38 keeps debris out of the splines 36 to increase reliability of the tool. Top sub 20 is thus rotationally secured to the clutch 34, so that the clutch rotates with the top sub.

Figure 1C:
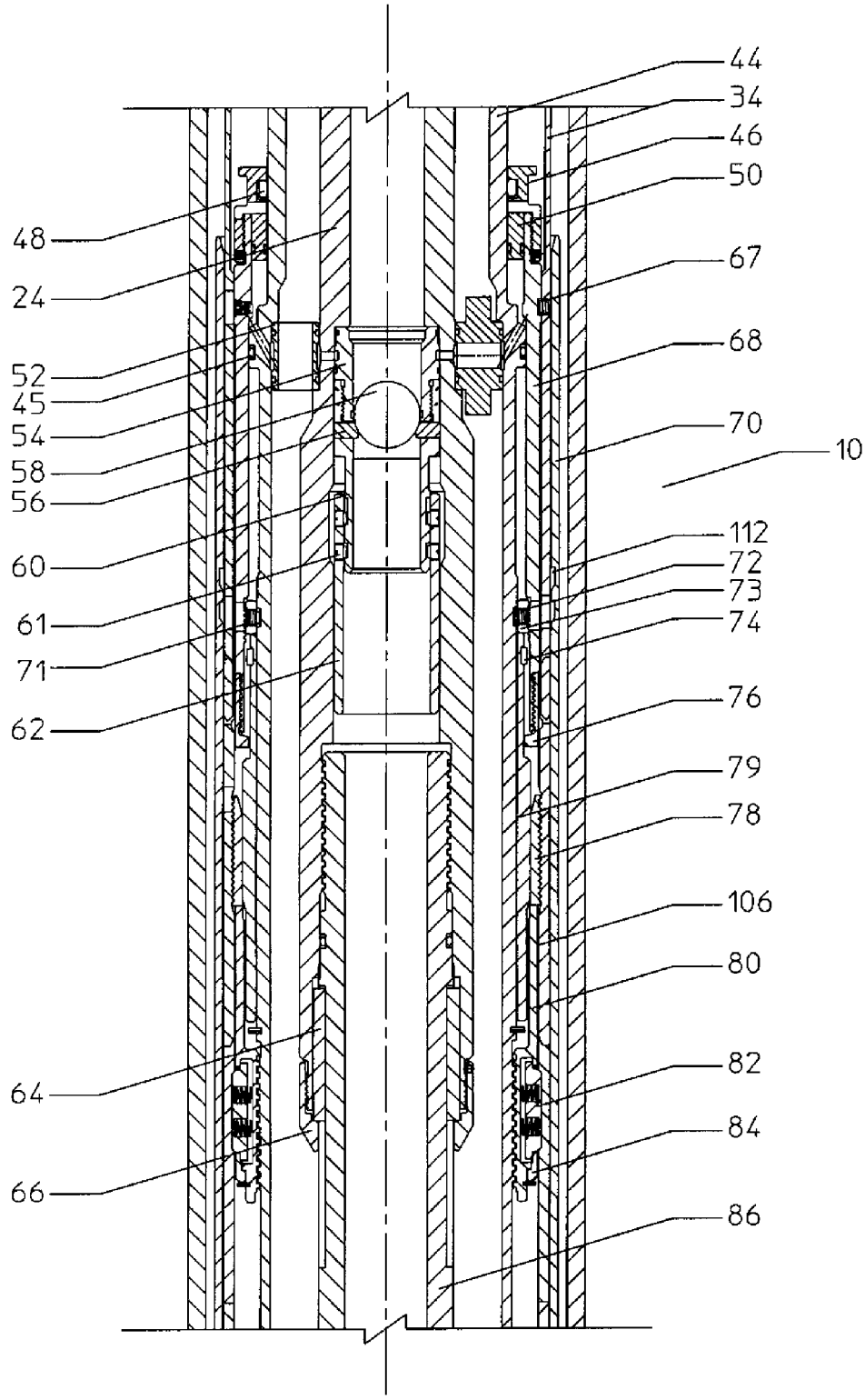
FIG. 1C illustrates a hydraulic release portion of the running tool.

Referring now to FIG. 1C, the lower end of the clutch 34 is axially interconnected to piston housing 68 with pin 67. An upper portion of the tie back receptacle 70 and the running adapter 106 are shown in FIG. 1C, and each is part of the liner when positioned in the well, as discussed below. Pin 72 interconnects the outer piston mandrel 44 with piston housing 68, and keeps piston housing 68 from moving upward until a desired pressure in the running tool is obtained to release the running tool from a liner. Shear pin 72 may thus be set, for example, to shear at 2,000 psi pressure. Shear screws 72 may each be threaded into a respective shear ring 73, which in turn is threaded to the piston housing 68 so that the shear screws 72 go through the shear ring 73 and into the piston mandrel 44. Snap ring 74 resides in a groove in the sleeve 79. After the ball sleeve 60 moves down, as explained below, pressure is applied to shear the pins 72, thereby allowing the piston housing 68 to move axially upward several inches until the ring 76 engages the snap ring 74, which will release the cam ring 79 from under the running ring 78 and release the running tool from the liner. Piston housing 68 may be threaded to the shear ring 73 with threads 71 shown in FIG. 1C.

Cap 76 is provided at the lower end of the housing 68, and a support sleeve 79 retains the running ring 78 in secured engagement with the profile 114 (see FIG. 5) in the running adapter 106. Lug housing 80 supports a plurality of circumferentially arranged lugs 82 which are retained by lug retainer 84. The mandrel 44 includes an offset extension portion 86 shown in the lower portion of FIG. 1C.

FIG. 1C also depicts piston cap 46 enclosing a split locking ring 48. Piston 50 is sealed to the outer surface of the housing 68, and to the inner surface of the piston mandrel 44. Seal 45 on the piston mandrel 44 seals with an interior surface of the housing 68.

FIG. 1C also depicts ball seat insert 54 and seat 56 for receiving ball 58 dropped through the bore 14 in the drill pipe 12. Operation of this mechanism is discussed further below. A ball seat housing 60 is axially movable within a sleeve 62 when a plurality of shear members 61 shear. A lower end of the mandrel 24 rotationally interconnects to the extension 86 by a plurality of keys 64 each retained by a keycap 66. FIG. 1C also depicts the ported adapter 52, which is discussed in further detail below.

Figure 1D:
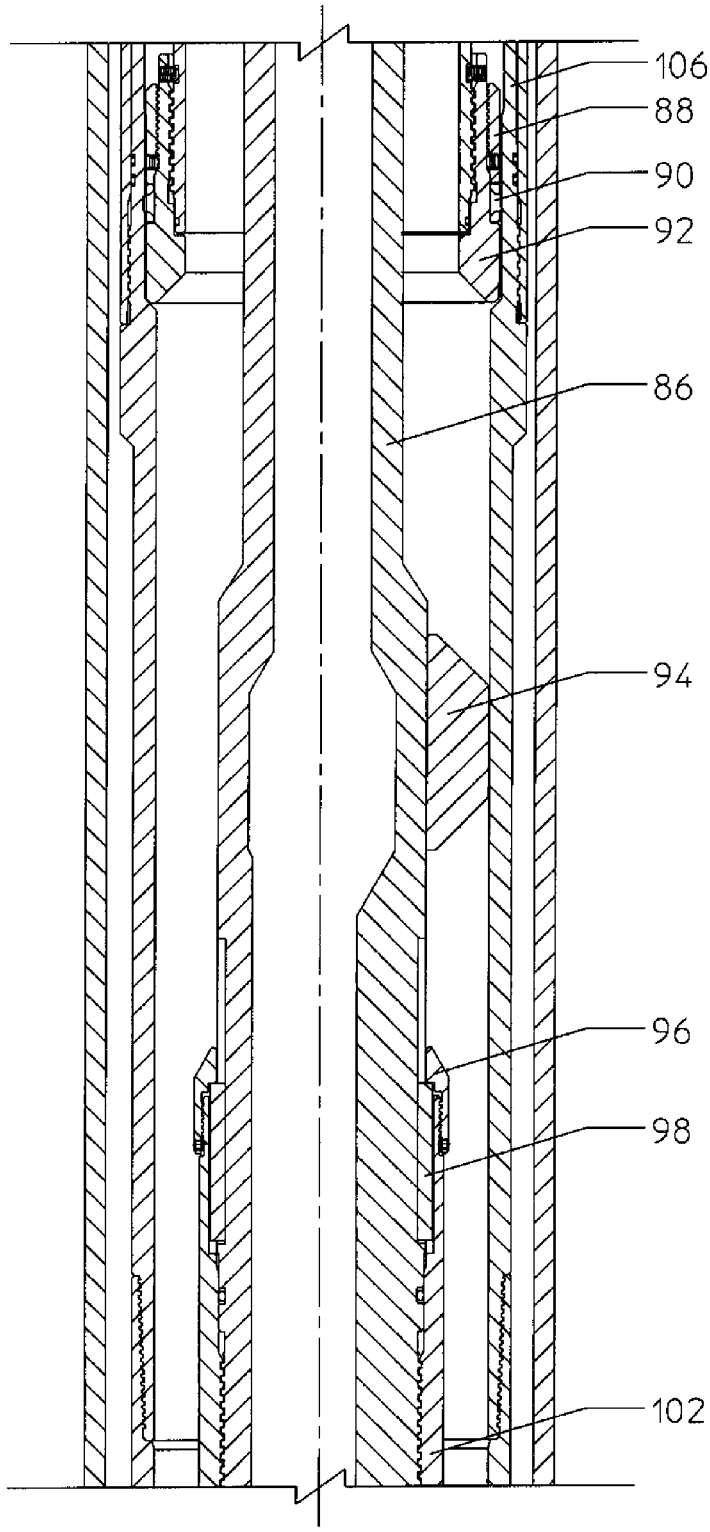
FIG. 1D illustrates a lower portion of the running tool.

Referring now to FIG. 1D, the lower end of the piston mandrel 44 is threaded to a nogo ring 92, with a seal 90 provided between the exterior of the ring 92 and the interior of the running adapter 106. Seal 90 may be held in place by retainer 88. Mandrel extension 86 extends downward to support a centralizer 94, which conventionally consists of three centralizer blades at 120° intervals. Key 98 rotationally interconnects the mandrel extension 86 to bottom sub 102, which is shown in greater detail in FIG. 1E. Key 98 is held in place by retainer 98.

Figure 1E:
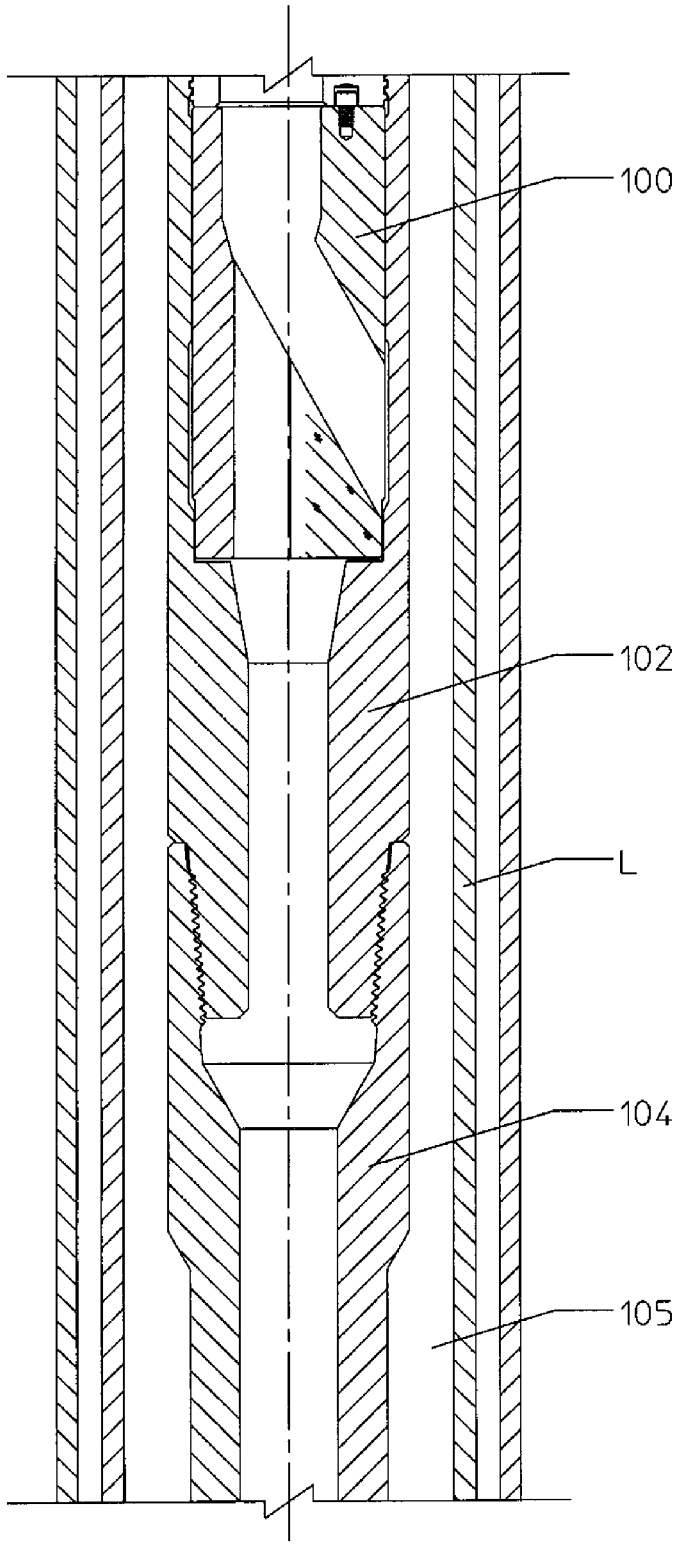
FIG. 1E illustrates a ball diverter portion of the running tool.

FIG. 1E depicts a ball diverter 100 supported on the bottom sub 102, with a lower drill pipe 104 extending downhole to a bottomhole assembly (not shown), which may be rotated by torque transmitted from the drill pipe through the running tool 10.

Figure 2:
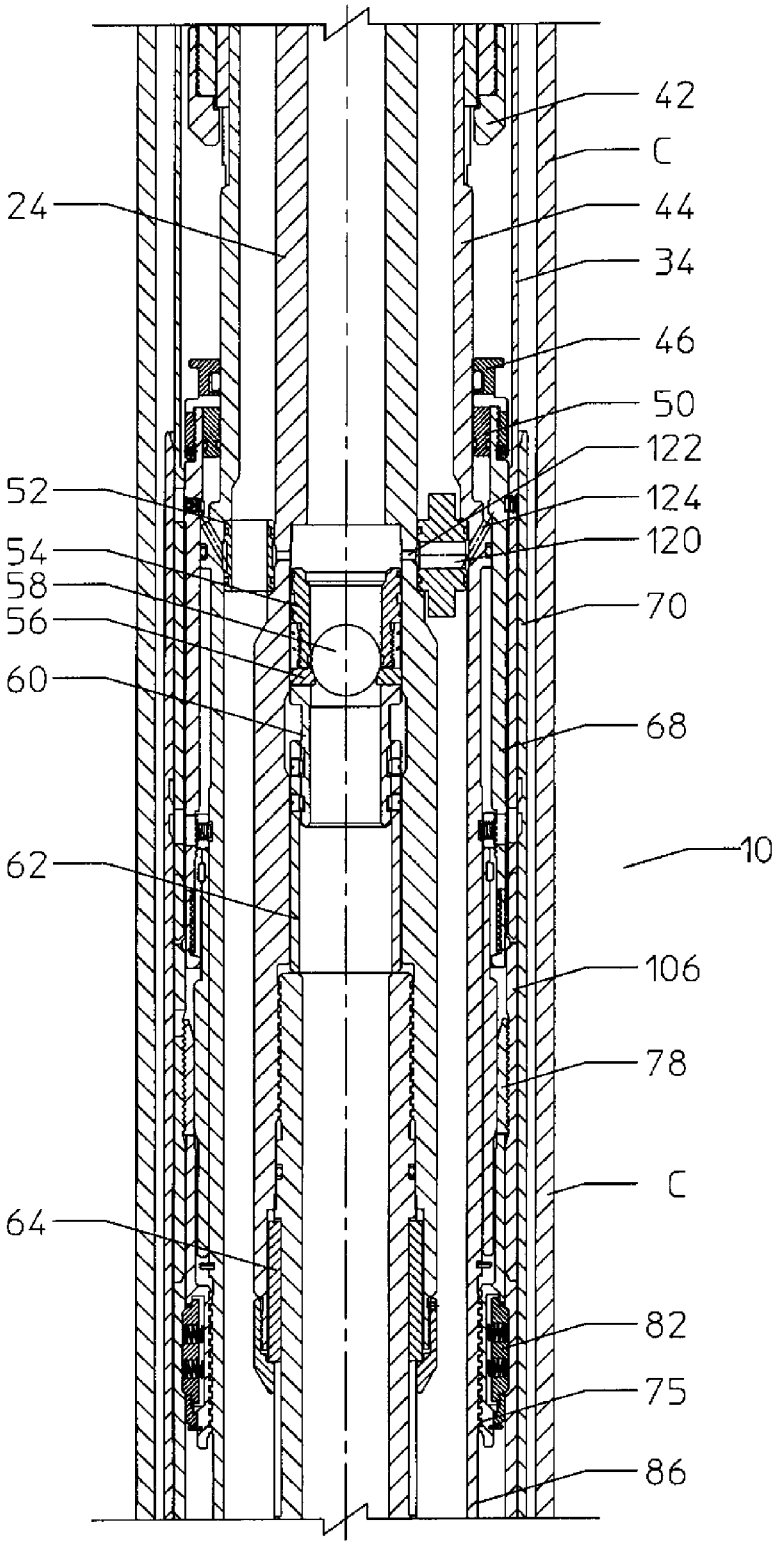
FIG. 2 illustrates the hydraulic release mechanism shown in FIG. 1C with the seat moved axially downward.
Figure 6:
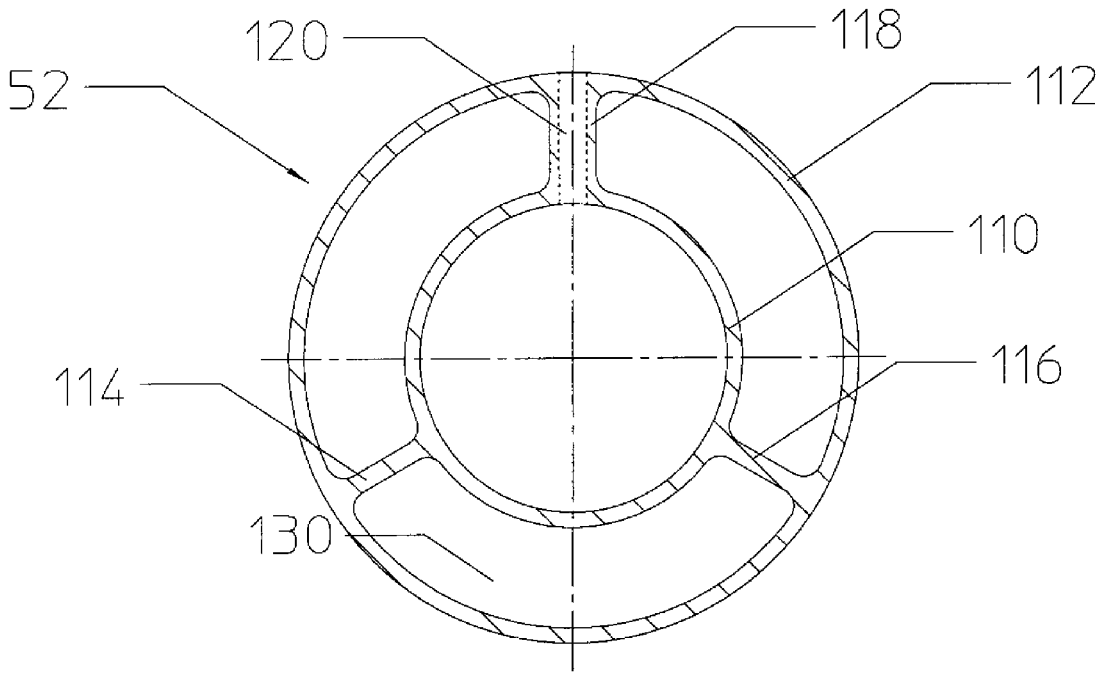
FIG. 6 is a top view of the ported adapter shown in FIG. 1C.

FIG. 6 depicts a top view of the ported adapter 52, including an annular inner ring 110 and a radially spaced annular outer ring 112. The inner surface of ring 110 is in sealed engagement with the mandrel 24, while the outer surface of ring 112 is in sealed engagement with the piston mandrel 44. FIG. 2 depicts conventional o-rings for maintaining sealed engagement between the port adapter 52 and both the mandrel 24 and piston mandrel 44. Annular gap 130 is sizable and extends radially between the outer sleeve 112 and the inner sleeve 110 for passage of fluid through the tool without significantly restricting the flow or causing a significant pressure drop. More particularly, the minimum cross-sectional flow area in the annulus between the mandrel 24 and the aston mandrel 44, is at least 2.5 times the minimum cross-sectional flow area between either the liner running adapter 106 or the tie back receptacle 70, which are each 15 functionally part of the liner, and the casing C. The inner and outer rings are interconnected by radially extending ribs 114 and 116, each having a circumferential thickness of only several degrees. The rib 118 is slightly larger, since the flow path 120 is provided through the rib 118 for fluid communication to the piston 50.

Referring now to FIGS. 2 and 6, pressure will increase in the mandrel 24 above the seated ball, and will pass through port 122 in the mandrel 24, through the passageway 120 in the ported adapter 52, and through the passage 124 in the piston mandrel 44, thereby exposing pressurized fluid to the bottom of piston 50 and moving the piston upward. The ported adapter 52 thus has the purpose of passing fluid upward through the tool to a position above the liner, while also serving as a seal unit to allow fluid to pass from the interior of the mandrel 24 to the piston 50, which as noted above is radially outward of the piston mandrel 44.

Referring now to FIG. 2, the ball 58 is shown landed on seat 56, and pressure in the drill pipe above the seated ball may be increased, e.g., to 500 psi, which is sufficient to shift the subassembly including the ball seat insert 54, the ball seat 56, the ball seat housing 60 and the ball seat shear release sleeve 62 downward, so that fluid pressure can now be applied to the piston 50 and the piston housing 68. At this stage, the lower end of the sleeve 62 has thus landed on the upper end of the mandrel extension 86.

Figure 3:
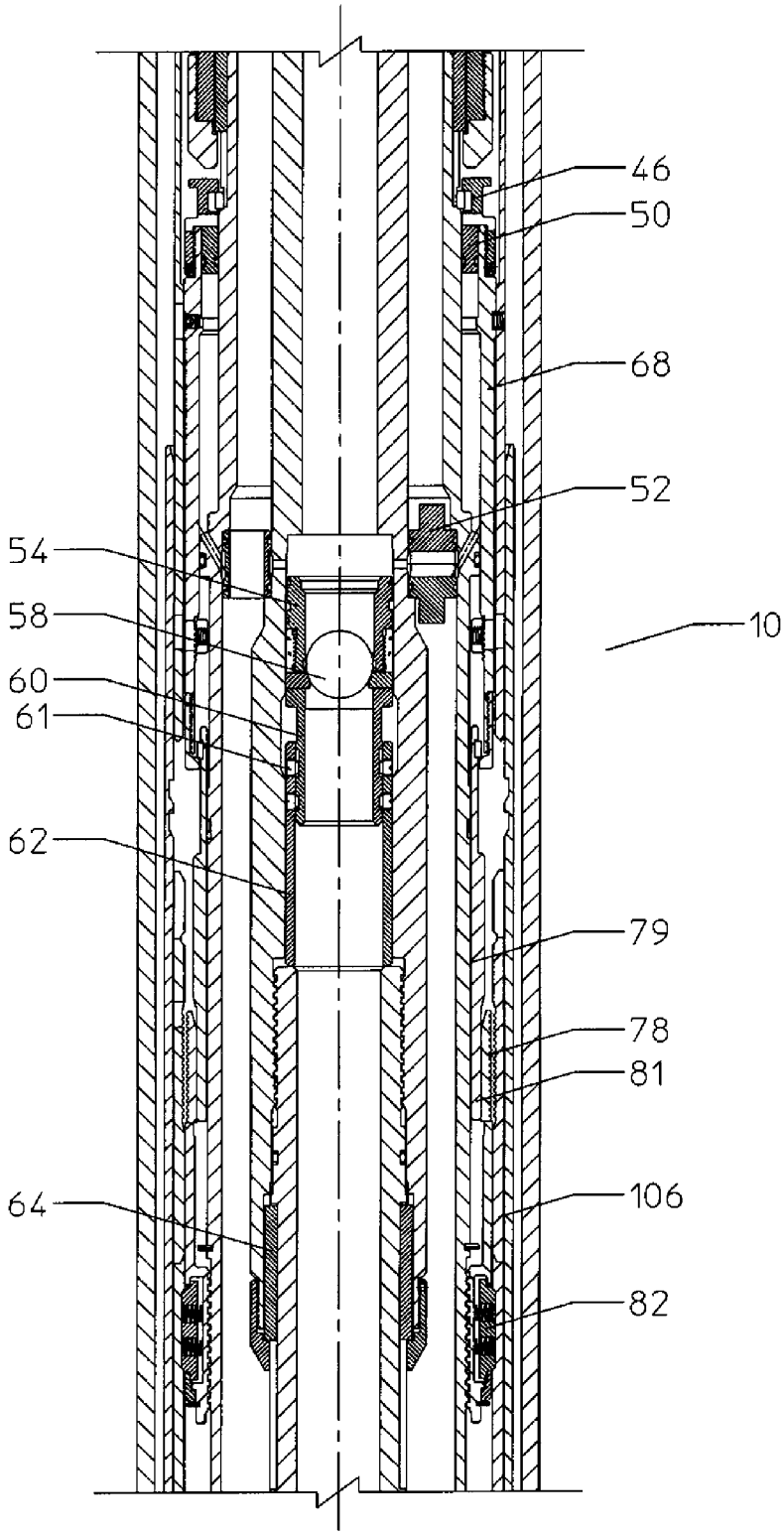
FIG. 3 illustrates a hydraulic release portion of the tool with fluid pressure in the mandrel applied to axially move a piston and thereby release the running tool from the liner hanger.

Referring now to FIG. 3, fluid pressure applied to the piston 50 will raise the piston and the housing 68 from the position as shown in FIG. 2 to the raised position as shown in FIG. 3. Pressure may thus be increased to, e.g. 2,000 psi, to shift the piston 50 and the piston housing 68 axially upward, which will pull the support sleeve 79 up, allowing the reduced thickness portion 81 of the sleeve to come axially in line with the running ring 78, thereby allowing the ring 78 to retract and disengage the tool from the upper end of the running adapter 106.

Figure 4:
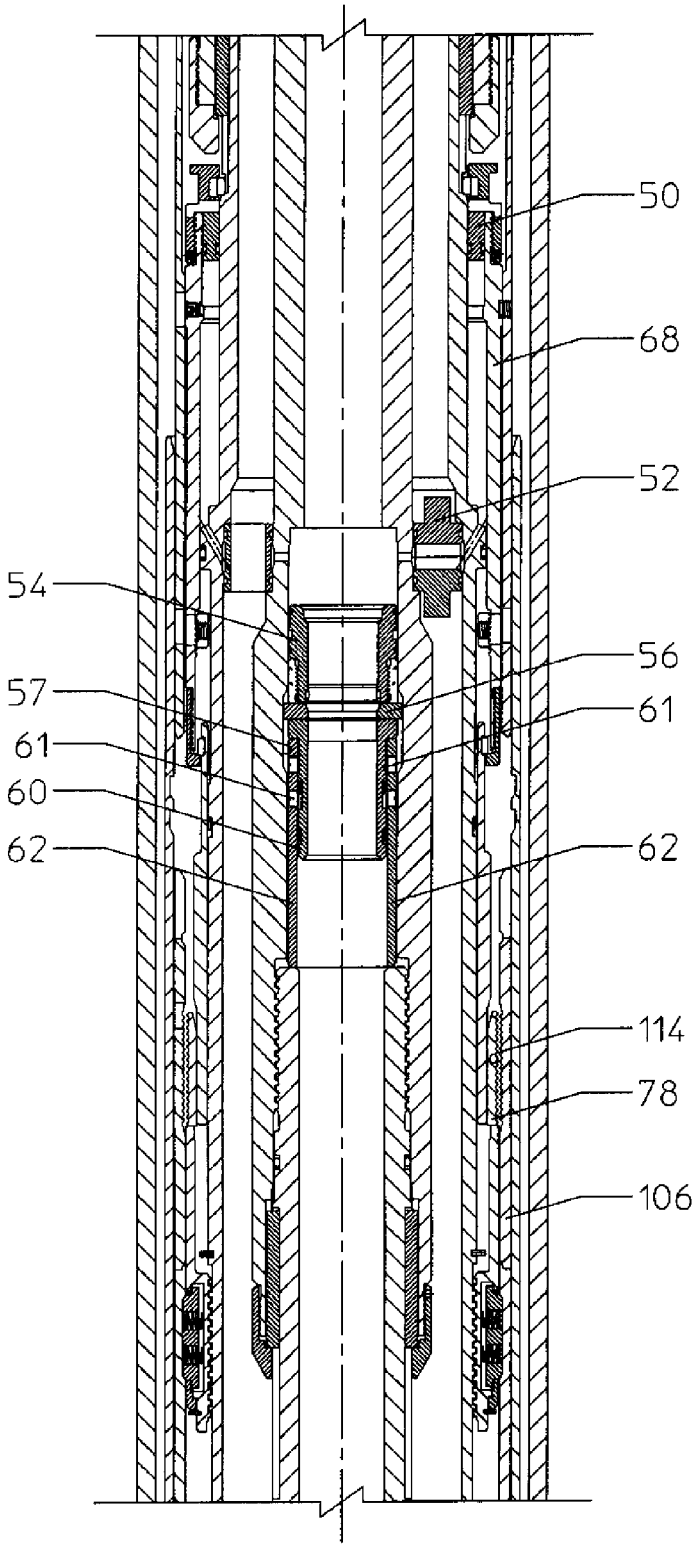
FIG. 4 illustrates the ball seat further lowered and the ball released.

Now that the tool is released from the liner hanger, pressure may be further increased, e.g., to 5,000 psi, to shear the pins 61 between the ball seat housing 60 and the sleeve 62, thereby allowing the sleeve 60 to move downward relative to sleeve 62 and allowing seat 56 to move into the enlarged diameter portion 57 of the mandrel, as shown in FIG. 4, allowing the ball to pass downward to the ball diverter 100 shown in FIG. 1E.

Figure 5:
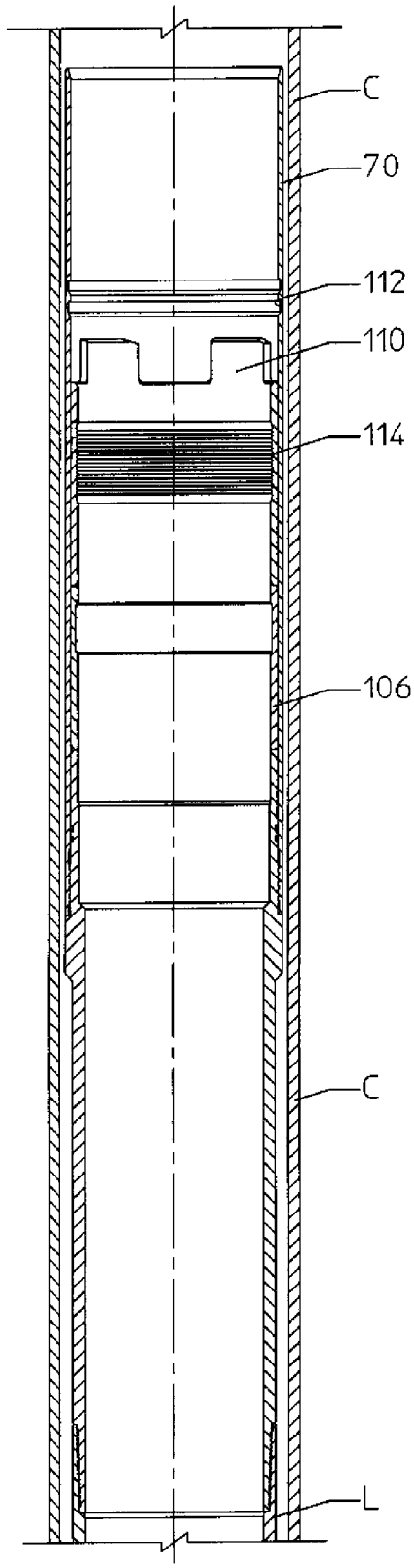
FIG. 5 illustrates the liner positioned in the well and the running tool retrieved to the surface.

FIG. 5 illustrates the upper end of liner L positioned within a casing C. Running adapter 106 extends upward from the liner, and the tie back receptacle 70 extends upward from the running adapter 106. A selected profile, such as teeth 110, are shown at the upper end of the running adapter, and engage corresponding teeth on the clutch to allow torque to be transmitted through the tool to the liner and to a bottomhole assembly, while allowing for disengagement of the clutch teeth when the tool is returned to the surface. FIG. 5 also shows a pair of annular grooves or slots 112 in the tieback 70. After the running tool is removed from the liner, the grooves 112 may be used to latch in a second trip packer. After the liner is run in and dropped off within the wellbore, a liner top isolation packer may thus be run back into the well and latched to the liner using the grooves 112, with a seal between the liner and the liner top packer. Interior profile 114 on the running adapter 106 is configured for engagement with the mating profile on the running ring 78.

During run-in of the tool and the liner, fluid in the well may pass upward in the annulus 105 shown in FIG. 1E between the mandrel and the liner. Fluid may thus pass upward between the mandrel 24 and the piston mandrel 44, as shown in FIG. 1C, and may exit the tool at the slots 32 above the liner, as shown in FIG. 1B, so that fluid may continue upward between the tool and the casing C. A smaller portion of fluid flow may still occur between the running adapter or the tie back receptacle and the casing.

Once the liner is positioned at a desired depth in the well, the hydraulic release mechanism as discussed above may release the tool from the liner, as shown in FIG. 3, so that the tool may then be returned to the surface. In the event that hydraulic release of the tool from the liner cannot be accomplished, the tool may be manually released by rotating the work string 12. With the ball seated, piston 50 will move upward in response to hydraulic pressure, thereby raising the clutch 34 to de-clutch the tool from the liner. With the clutch disengaged, the operator may rotate the work string 12 and thus the tool so that the left-hand thread 75 between the mandrel 44 and the lug housing 80 as shown in FIG. 2 may disengage. The tool may then be picked up a short distance so that it is disengaged from the liner hanger, and may then be returned to the surface. Further details regarding a suitable mechanism for manual release of the tool from the liner is disclosed in U.S. Pat. No. 6,739,398.

Those skilled in the art will appreciate that a clutch mechanism as disclosed herein is preferable for transmitting torque through the tool to the liner to rotate the liner, and optionally rotate a bottomhole assembly including a bit at the lower end of a liner, while positioning the liner at a selected depth in the well. Other mechanisms may be used, for transmitting torque from the workstring through the tool and to the liner, and for allowing the tool to be released from the liner when positioned at the selected depth within the well. Also, various types of balls or other plugs may be used to land on the seat and increase fluid pressure above the set plug, and the above discussion of a ball should not be construed as limiting the type of plug.

Those skilled in the art will also appreciate that the tool disclosed herein may be used for positioning a liner at a selected depth within a well, and that another tool may subsequently be used to set the liner at that selected depth by securing the liner to the casing. The tool as disclosed herein allows the liner to be reliably positioned at a selected depth in a well, and this is facilitated by allowing fluid to pass internally through the tool and above the liner, while also transmitting torque through the tool to rotate the liner. Once the liner is at its desired depth within a well, the running tool may be returned to the surface, leaving the liner in place. Another tool may subsequently be lowered in the well and may be used to seal the liner. In other applications, the running tool with the internal bypass as disclosed herein may be used with liner setting components that allow the liner to be positioned in the well and then set within the casing.

Although specific embodiments of the invention have been described herein in some detail, this has been done solely for the purposes of explaining the various aspects of the invention, and is not intended to limit the scope of the invention as defined in the claims which follow. Those skilled in the art will understand that the embodiment shown and described is exemplary, and various other substitutions, alterations and modifications, including but not limited to those design alternatives specifically discussed herein, may be made in the practice of the invention without departing from its scope.

What is claimed is:

1. A liner hanger running tool to position a liner within a casing in a wellbore, comprising:

a tool mandrel having a throughbore and supported on a running string;

a piston mandrel surrounding the tool mandrel;

a piston housing surrounding the piston mandrel;

the liner circumferentially surrounding at least a portion of the piston mandrel;

a flow annulus having a radially inner surface defined in part by an outer surface of the tool mandrel and having a radially outer surface defined in part by an inner surface of the piston mandrel, the flow annulus having an annular cross-sectional configuration defining a flow path for fluid entering the flow annulus from an annulus exterior of the running tool and passing upwards through the running tool to a position above the liner and in fluid communication with the annulus exterior of the running tool and interior of the casing, the fluid passing in the flow annulus upward through the running tool while the running tool and liner are lowered in the wellbore; and a hydraulic release mechanism activated by fluid pressure within the tool mandrel to axially move a piston positioned radially outward of the piston mandrel to release the running tool from the liner.

2. The liner hanger running tool as defined in claim 1, further comprising:

a radial throughport in the tool mandrel in fluid communication with the tool mandrel throughbore;

a radial throughport in the piston mandrel for passing fluid to the piston; and an annular seal unit in the flow annulus between the tool mandrel and the piston mandrel for fluid communication from the radial throughport in the tool mandrel to the radial throuqhport in the piston mandrel, the annular seal unit having a radially inner surface sealed to the tool mandrel and a radially outer surface sealed to the piston mandrel.

3. The liner hanger running tool as defined in claim 1, further comprising:

a backup releasing mechanism for releasing the running tool from the set liner, the backup releasing mechanism including left hand threads interconnecting a lower portion of the running tool and an upper portion of the running tool.

4. The liner hanger running tool as defined in claim 1, wherein the minimum cross-sectional flow area in the annulus between the tool mandrel and the piston mandrel is at least 2.5 times the minimum cross-sectional flow area between an exterior surface of a liner hanger running adapter and an interior surface of the casing.

5. The liner hanger running tool as defined in claim 1, further comprising:

a clutch mechanism for transmitting torque through the running tool to rotate the liner, the clutch mechanism disengaging to enable release of the running tool from the liner.

6. The liner hanger running tool as defined in claim 5, wherein the clutch mechanism is rotationally connected to the housing by one or more axially extending splines.

7. The liner hanger running tool as defined in claim 1, wherein an outer surface of the piston seals with the piston housing and an inner surface of a piston seals with the piston mandrel.

8. The liner hanger running tool as defined in claim 1, further comprising:

a plug seat within the tool mandrel throughbore for seating with a plug, the plug seat axially movable to release the plug from the seat.

9. The liner hanger running tool as defined in claim 8, further comprising:

a plug diverter at a lower end of the tool mandrel for capturing the plug.

10. A liner hanger running tool to position a liner within a casing in a wellbore, comprising:

a tool mandrel having a throughbore and supported on a running string;

a piston mandrel surrounding the tool mandrel;

a piston housing surrounding the piston mandrel;

a liner circumferentially surrounding at least a portion of the piston mandrel;

a flow annulus between an outer surface of the tool mandrel and an inner surface of the piston mandrel defining a flow path for fluid entering the flow annulus from an annulus exterior of the running tool and passing upwards through the running tool to a position above the liner and in fluid communication with an annulus exterior of the running tool and interior of the casing, the fluid passing in the flow annulus upward through the running tool while the running tool and liner are lowered in the wellbore;

a radial throughport in the tool mandrel, in fluid communication with the tool mandrel throughbore;

a radial throughport in the piston mandrel for passing fluid to the piston; and an annular seal unit in the flow annulus between the tool mandrel and the piston mandrel for fluid communication from the radial throughport in the tool mandrel to the radial throughport in the piston mandrel, the annular seal unit having a radially inner surface sealed to the tool mandrel and a radially outer surface sealed to the piston mandrel; and a hydraulic release mechanism activated by fluid pressure within the tool mandrel to axially move a piston to release the running tool from the liner.

11. The liner hanger running tool as defined in claim 10, further comprising:

a backup releasing mechanism for releasing the running tool from the set liner, the backup releasing mechanism including left hand threads interconnecting the lower portion of the running tool and the upper portion of the running tool.

12. The liner hanger running tool as defined in claim 10, wherein the minimum cross-sectional flow area in the annulus between the tool mandrel and the piston mandrel is at least 2.5 times the minimum cross-sectional flow area between an exterior surface of a liner hanger running adapter and an interior surface of the casing.

13. The liner hanger running tool as defined in claim 10, further comprising:

a clutch mechanism for transmitting torque through the running tool to rotate the liner, the clutch mechanism disengaging to enable release of the running tool from the liner.

14. The liner hanger running tool as defined in claim 13, wherein the clutch mechanism is rotationally connected to the housing by one or more axially extending splines.

15. A method of positioning a liner at a selected depth within a casing in a wellbore, comprising:

supporting a tool mandrel on a running string;

providing a piston mandrel surrounding the tool mandrel;

providing a piston housing surrounding the piston mandrel;

providing a liner circumferentially surrounding at least a portion of the piston mandrel;

providing a flow annulus having a radially inner surface defined in part by an outer surface of the tool mandrel and having a radially outer surface defined in part by an inner surface of the piston mandrel to define a flow path having an annular cross sectional configuration for fluid entering the flow annulus from an annulus exterior of the running tool and passing upwards through the running tool to a position above the liner, and in fluid communication with an annulus exterior of the running tool and interior of the casing, the fluid passing in the flow annulus upward through the running tool while the running tool and liner are lowered in the wellbore; and creating a desired level of fluid pressure within the tool mandrel to axially move a piston radially outward of the piston mandrel to release the running tool from the liner.

16. The method as defined in claim 15, further comprising:

providing a radial throughport in the tool mandrel in fluid communication with a throughbore in the tool mandrel;

providing a radial throughport in the piston mandrel for passing fluid to the piston; and providing an annular seal unit in the flow annulus between the tool mandrel and the piston mandrel for fluid communication from the radial throughport in the tool mandrel to the radial throughport in the piston mandrel, the annular seal unit having a radially inner surface sealed to the tool mandrel and a radially outer surface sealed to the piston mandrel.

17. The method as defined in claim 15, further comprising:

releasing the running tool from the liner with a backup releasing mechanism including left hand threads interconnecting a lower portion of the running tool and an upper portion of the running tool.

18. The method as defined in claim 15, wherein the minimum cross-sectional flow area in the annulus between the tool mandrel and the piston mandrel is at least 2.5 times the minimum cross-sectional flow area between an exterior surface of a liner hanger running adapter and an interior surface of the casing.

19. The method as defined in claim 15, further comprising:

transmitting torque through the running tool to rotate the liner.

20. The method as defined in claim 15, wherein an outer surface of the piston seals with the piston housing and an inner surface of a piston seals with the piston mandrel.

* * * * *